US007555135B1

(12) United States Patent
Harb

(10) Patent No.: US 7,555,135 B1
(45) Date of Patent: Jun. 30, 2009

(54) TOOL FOR HEARING AID ADJUSTMENT

(76) Inventor: Mitchell A. Harb, P.O. Box 261, Lexington, NC (US) 27293

( * ) Notice: Subject to any disclaimer, the term of this patent is extended or adjusted under 35 U.S.C. 154(b) by 0 days.

(21) Appl. No.: 12/069,248

(22) Filed: Feb. 8, 2008

(51) Int. Cl.
*H04R 25/00* (2006.01)

(52) U.S. Cl. ..... 381/329; 381/322

(58) Field of Classification Search ..... 381/329
See application file for complete search history.

(56) References Cited

U.S. PATENT DOCUMENTS 3,061,689 A * 10/1962 McCarrell et al. ..... 381/328
3,170,046 A * 2/1965 Leale ..... 381/328
3,702,123 A 11/1972 Macken et al. ..... 181/23
D273,707 S 5/1984 McCall ..... D24/35
5,003,608 A 3/1991 Carlson ..... 381/68.6
5,295,191 A 3/1994 Van Vroenhoven ..... 381/68.6
5,395,168 A 3/1995 Leenen ..... 381/68.6
6,055,319 A 4/2000 Shennib et al. ..... 381/328
6,529,609 B1 3/2003 Neilson et al. ..... 381/329
2004/0072511 A1 * 4/2004 Launius, Jr. ..... 451/523

* cited by examiner

*Primary Examiner*—Brian Ensey
(74) *Attorney, Agent, or Firm*—Richard C. Litman

(57) ABSTRACT

A tool for adjusting the volume of a hearing aid having a rotating dial. A method of adjusting the volume of such a hearing aid with a tool.

5 Claims, 5 Drawing Sheets

TOOL FOR HEARING AID ADJUSTMENT

FIELD OF THE INVENTION

The invention disclosed herein relates generally to a tool for volume adjustment and, more particularly, to a tool for rotating a volume dial on a hearing aid while the hearing aid is positioned in the ear.

DESCRIPTION OF THE PRIOR ART AND OBJECTIVES OF THE INVENTION

Hearing aids often have a volume control dial positioned on the outside for adjusting the volume of the aid while inserted in the ear. The dial often has structural features on an outer surface to assist a user in turning the dial with his or her finger. While these structural features can be helpful, people who have physical limitations, such as some of the elderly, however, may yet have trouble turning the dial to adjust the volume.

An objective of the present invention is therefore to provide a tool that assists a person in rotating a dial on a hearing aid to adjust the volume of the hearing aid.

Another objective of the present invention is to provide a hearing system that includes a hearing aid having an adjustable dial and a tool for adjusting the dial.

Yet another objective of the present invention is to provide an improved method of adjusting the volume of one's own hearing aid while the aid is positioned in the ear.

Various other objectives and advantages of the present invention will become apparent to those skilled in the art as a more detailed description is set forth below.

SUMMARY OF THE INVENTION

The aforesaid and other objectives are realized by providing a tool for rotating a volume dial of a hearing aid. In the preferred embodiment of the invention, the tool includes a shaft having ends each defining an opening for receiving protuberances on a volume control dial of a hearing aid. Either end of the shaft can be used to rotate the dial to adjust the volume. In an alternative embodiment of the tool, only one end of the shaft defines an opening for receiving the protuberances of the dial.

Preferably, the shaft is generally symmetrical with tapered ends. Each end has an edge defining the outer margin of an interior opening that extends inwardly to an interior wall. Each opening is of sufficient depth to receive the protuberances therein while the edge frictionally engages the dial. The shaft includes adjacent ridges extending axially which provides a textured outer surface for improved handling of the tool.

DETAILED DESCRIPTION OF THE PREFERRED EMBODIMENT AND OPERATION OF THE INVENTION

Figure 1:
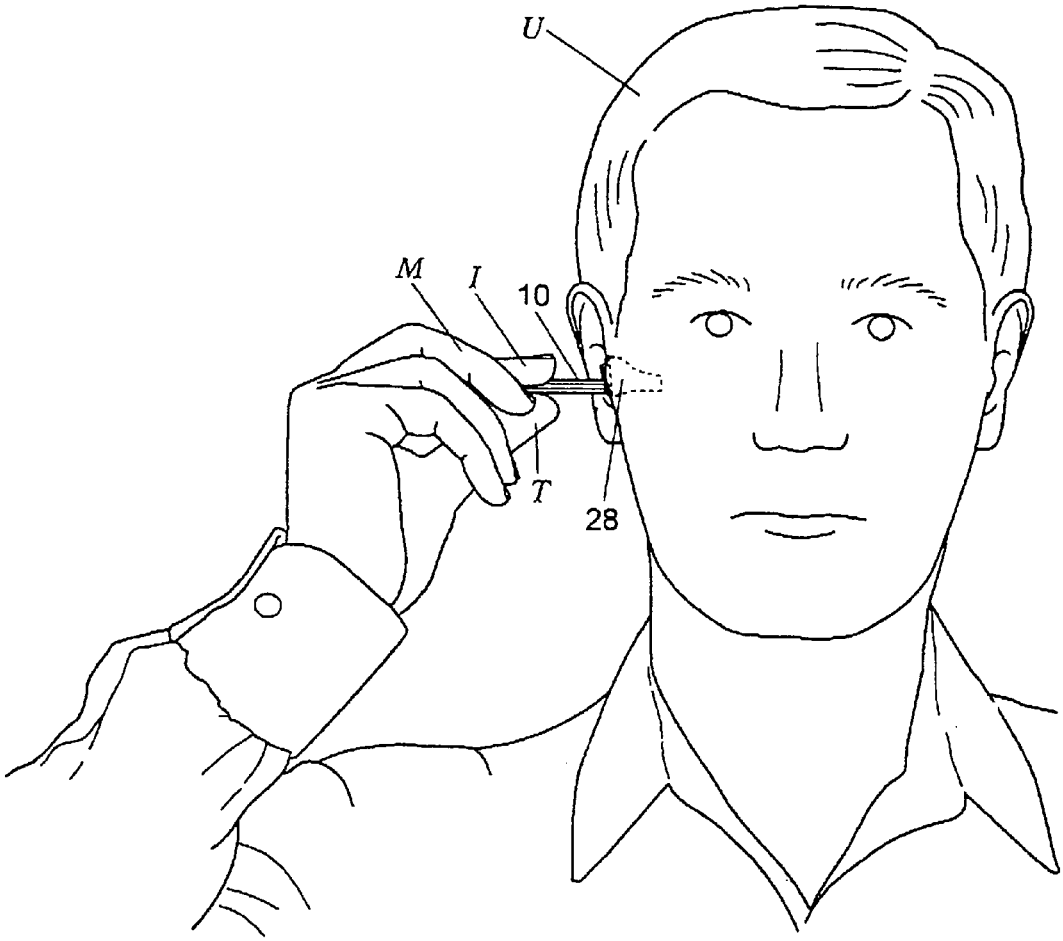
FIG. 1 is a front elevational view showing a person wearing a hearing aid shown in ghost fashion with the preferred embodiment of the tool in place for adjusting the hearing aid volume.
Figure 2:
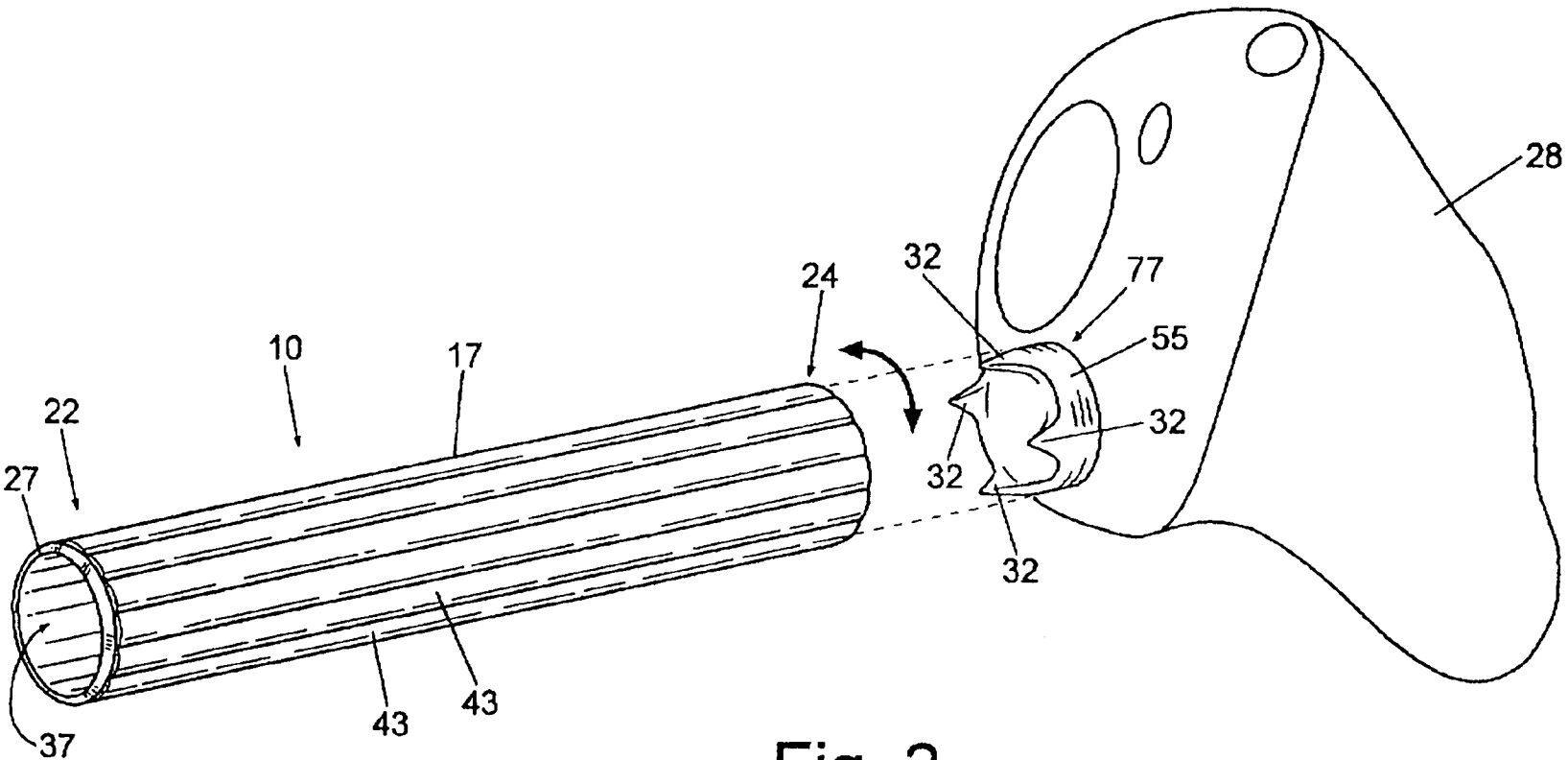
FIG. 2 is a side perspective of the tool as seen in FIG. 1 exploded from a standard in-ear hearing aid.
Figure 3:
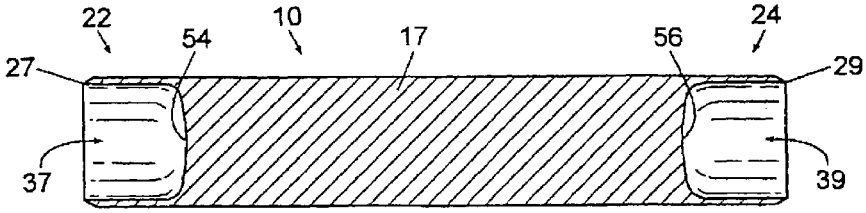
FIG. 3 depicts a cross-sectional view of the preferred embodiment of the tool for adjusting the volume of a hearing aid.

Turning now to the drawings, specifically, FIG. 1 shows tool 10 for adjusting hearing aid 28 positioned in the ear of user U. Tool 10 can be grasped using thumb T, index finger I and middle finger M and placed on dial 77 as seen in FIG. 2 of hearing aid 28 for volume adjustment.

FIGS. 2, 3, 5 and 6 show the preferred embodiment of tool 10 including shaft 17 having opposing, tapered ends 22, 24 each defining, respectively, an interior opening 37, 39 (FIG. 3) for receiving protuberances 32 on cylindrical body 55 of dial 77 for volume control of hearing aid 28. Adjacent ridges 43 form the outer surface of shaft 17 as shown particularly in FIGS. 2, 5 and 6. Interior opening 37 extends inwardly from an outer terminus defined by circular edge 27 of end 22 to interior wall 54 with a generally cylindrical shape. End 24 is constructed similarly including circular edge 29 and interior wall 56 yet need not be identical to end 22. The depth of openings 37, 39, for example, may be different so long as each opening 37, 39 is deep enough to receive protuberances 32. Either end 22 or 24 can then be placed to dial 77 with respectively edge 27 or 29 fitting snugly around protuberances 32 to provide a friction joint. With tool 10 so positioned, rotating tool 10 rotates dial 77 to adjust the volume of hearing aid 28.

Figure 4:
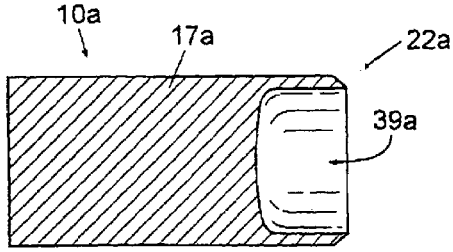
FIG. 4 is a cross-sectional view of an alternative embodiment of the tool as shown in FIGS. 2 and 3.
Figure 5:
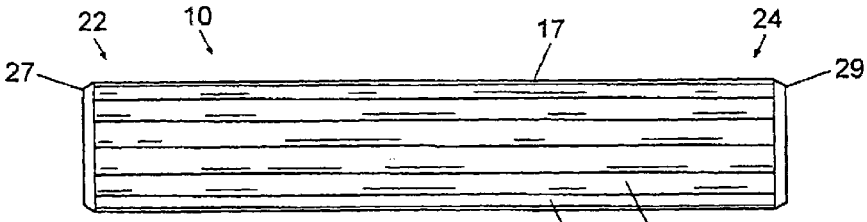
FIG. 5 features a top plan view of the preferred embodiment of the tool, the right and left side elevations and bottom plan views are identical thereto.
Figure 6:
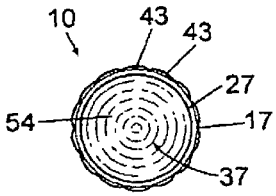
FIG. 6 is a front elevational view of the preferred embodiment of the tool, the back elevational view being identical thereto.

FIG. 4 shows a cross-sectional view of alternative embodiment tool 10*a*. In alternative embodiment 10*a*, only one end 22*a* of shaft 17*a* defines an opening 39*a*. As would be understood shaft 17*a* is likewise formed having adjacent ridges on the outer surface for ease in handling and manipulation.

Figure 7:
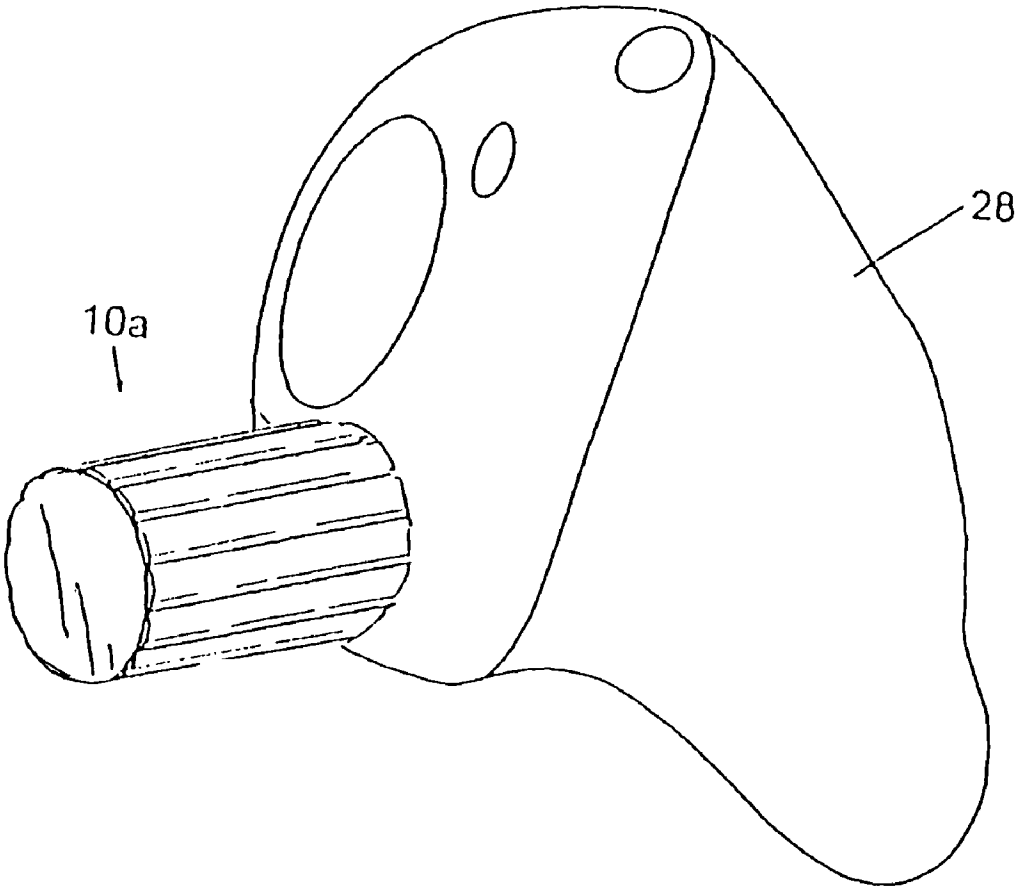
FIG. 7 is a side perspective of the tool as seen in FIG. 4 positioned over the volume control of a standard in-ear hearing aid.
Figure 8:
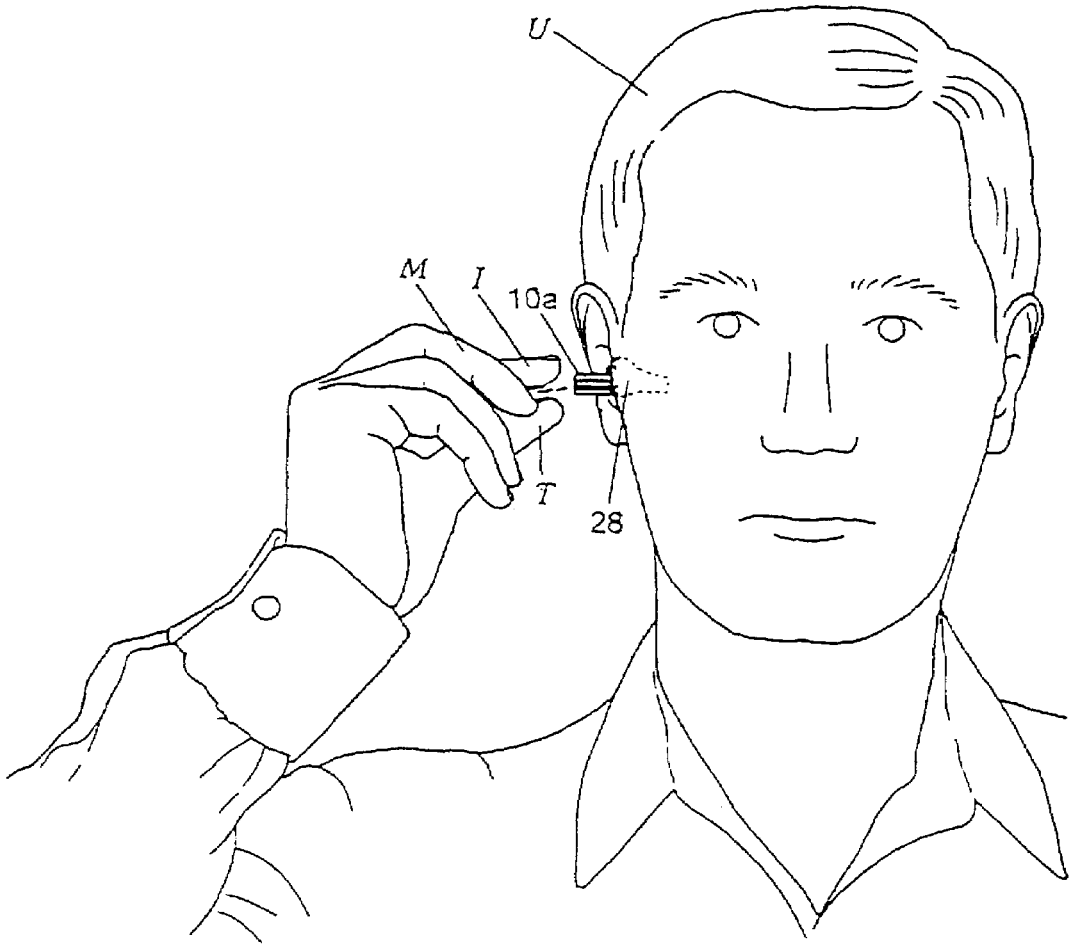
FIG. 8 is a front elevational view showing a person wearing a hearing aid (in ghost fashion) with the alternative embodiment of the tool affixed for adjusting the hearing aid volume.

FIG. 7 depicts tool 10*a* positioned on volume control knob 77 before placement in the wearer's ear. In FIG. 8, tool 10*a* and hearing aid 28 are shown inserted in the wearer's ear. By placing tool 10*a* on hearing aid 28, the hearing aid can then be easily placed in the ear, the volume adjusted, and then tool 10*a* can be removed and stored for future adjustments as needed.

With reference to the figures in general and particularly to FIGS. 1 and 2, the preferred method of using tool 10 to adjust hearing aid 28 while inserted in the ear includes grasping tool 10 with thumb T, index finger I and middle finger M and placing one end 22 or 24 of tool 10 around protuberances 32 on volume dial 77 of hearing aid 28. With protuberances 32 in opening 37 or 39 and edge 27 or 29 contacting dial 77, tool 10 can be rotated to rotate dial 77 for adjusting the volume of hearing aid 28. With the volume of hearing aid 28 adjusted, tool 10 can be removed from aid 28 until further adjustment is desired.

The illustrations and examples provided herein are for explanatory purposes and are not provided to limit the scope of the appended claims.

I claim:

1. A tool for adjusting a hearing aid having a rotating volume dial defining a cylindrical body with protuberances thereon, said tool comprising:

a shaft, said shaft comprising an end, said end defining a cylindrical interior opening, said interior opening being of sufficient depth for receiving the dial, and said shaft further including an opposite end, said opposite end defining a cylindrical interior opening, said interior opening being of sufficient depth for receiving the dial, each of said end and opposite end terminating in circular edges and adapted to frictionally engage the protuberances of the dial.

2. The tool of claim 1 wherein said end and opposite end are tapered.

3. The tool of claim 1 wherein said shaft comprises ridges, said ridges adjacent one another extending axially on said shaft to form an outer surface of said shaft.

4. A hearing system comprising:

a hearing aid, said hearing aid comprising a volume dial, said dial on an outside of said hearing aid positioned to be accessible with said hearing aid in the ear, said dial rotatable to adjust said hearing aid, said dial comprising a cylindrical body and protuberances, said protuberances spaced apart on a surface of said cylindrical body; and a tool, said tool for rotating said dial, said tool comprising a shaft, said shaft comprising an end, said end defining a cylindrical interior opening, said interior opening being of sufficient depth for receiving the dial, and said shaft further including an opposite end, said opposite end defining a cylindrical interior opening, said interior opening being of sufficient depth for receiving the dial, each of said end and opposite end terminating in circular edges and adapted to frictionally engage the protuberances of the dial.

5. The hearing system of claim 4 wherein said shaft comprises ridges, said ridges adjacent one another extending axially on said shaft to form an outer surface of said shaft.

* * * * *